US005193307A

United States Patent [19]

Chupp

[11] Patent Number: 5,193,307

[45] Date of Patent: Mar. 16, 1993

[54] DOUBLE DOOR SWING CONTROL

[76] Inventor: Ernest W. Chupp, 7831 Chicago Ct., Omaha, Nebr. 68114

[21] Appl. No.: 826,593

[22] Filed: Jan. 28, 1992

[51] Int. Cl.[5] ..... E05C 7/06

[52] U.S. Cl. ..... 49/123; 49/366

[58] Field of Search ..... 49/123, 115, 116, 118, 49/366

[56] References Cited

U.S. PATENT DOCUMENTS

| | | | |
|---|---|---|---|
| 615,194 | 11/1898 | Parkinson . | |
| 1,222,136 | 4/1917 | Reynolds . | |
| 1,529,798 | 3/1925 | Knapp et al. . | |
| 1,676,064 | 7/1928 | Vreeland . | |
| 1,841,868 | 1/1932 | Wuebling | 49/366 |
| 3,370,381 | 2/1968 | Wetter . | |
| 4,186,521 | 2/1980 | Hunter | 49/30 |
| 4,641,460 | 2/1987 | Kriegel | 49/115 |
| 4,733,498 | 3/1988 | Kriegel | 49/115 X |

*Primary Examiner*—Philip C. Kannan
*Attorney, Agent, or Firm*—John A. Beehner

[57] ABSTRACT

A double door swing control apparatus for facilitating the simultaneous opening of a pair of conventional, separately hinged double swing doors having hinges attached externally to the door such that the pivot axis of the door is external to the door. The invention includes a pair of spools and a pair of brackets secured to the top or bottom surface of the respective doors. A shaft connects each spool to a respective bracket, whereby movement of the associated door causes rotation of that spool. Cables connect and extend between the spools such that rotation of one spool causes an equal and opposite rotation of the other spool causing the doors to open and close in unison. The invention may be mounted either above or below the door.

9 Claims, 4 Drawing Sheets

DOUBLE DOOR SWING CONTROL

BACKGROUND OF THE INVENTION

1. Technical Field

This invention relates generally to the means and apparatuses used to open and close doors and more specifically to an apparatus which allows the user to simultaneously open both doors in a modern double swing door system having an external pivot axis, by opening one of the doors.

2. Description of the Prior Art

Devices allowing the simultaneous opening of double doors are not new. Such systems have been known in the door art for at least as far back as 1700's when Thomas Jefferson had such a system installed in his house. However, these older devices relied on the fact that the pivot axes of the doors were aligned with and intersected the doors. This design requires expensive construction including the provision of floor channels and special doors hinged with the pivot axis intersecting the door itself and thus is incompatible with modern door design.

In modern door design, doors are hinged on an axis which is located external to the door itself. Therefore, to operate with modern door designs a system must be capable of utilizing an "offdoor" pivot axis.

Although several prior art devices exist for the simultaneous opening and closing of gates or the like, none of the prior art apparatuses is capable of simultaneously opening two double swing doors incorporating a modern external pivot axis design.

3. Objects of the Invention

Accordingly, it is an object of the present invention to provide a door opening control which allows the user to simultaneously open a double swing door system of modern design.

It is a further object of the present invention to provide a kit containing the control which may be easily installed in a covered door frame.

It is a further object of the present invention to provide a control which may be mounted above the doors or in the floor below the doors.

It is a further object of the present invention to provide a door opening system which is easily installed in the existing frame structure of a modern door design.

It is a further object of the present invention to provide a door control system wherein the doors may be biased into various desired positions such as fully opened and fully closed.

It is a further object of the present invention to provide a door opening apparatus which is inexpensive, and simple to use.

SUMMARY OF THE INVENTION

The present invention is a double door swing control apparatus for facilitating the simultaneous opening of a pair of conventional, separately hinged double swing doors having hinges attached externally to the door such that the pivot axis of the door is external to the door. An example of such doors are those commonly referred to as French Doors. The invention includes a door control frame adapted to be mounted in a vertically spaced relation to the doors. A pair of spools are mounted on the door control frame, and a pair of brackets are secured to either the top or bottom of the respective doors. A pair of shafts are provided, each shaft being connected between a spool and one of the brackets for rotation of spool, shaft, and bracket in unison about the pivot axis of a respective door and in response to movement of such door. A pair of cables are connected to and extend between the spools such that rotation of one spool causes an equal and opposite rotation of the other spool, thereby causing a pair of double swing doors, having the brackets secured thereto, to open and close in unison. A shock absorbing attachment is interconnected to each cable thereby absorbing any shock resulting from sudden opening of the doors and providing a means for adjusting the tension in the cables. Additionally, a biasing track is attached to each spool and has a plurality of recesses therein such that when a biasing pin is urged against the track, the spool is biased into positions corresponding to the recesses, such as the door open and closed positions. The invention is designed so that it may be mounted as part of a kit or as individual components either above or below the door and so as not to require modification of the door frame structure.

DESCRIPTION OF A PREFERRED EMBODIMENT

Figure 1:
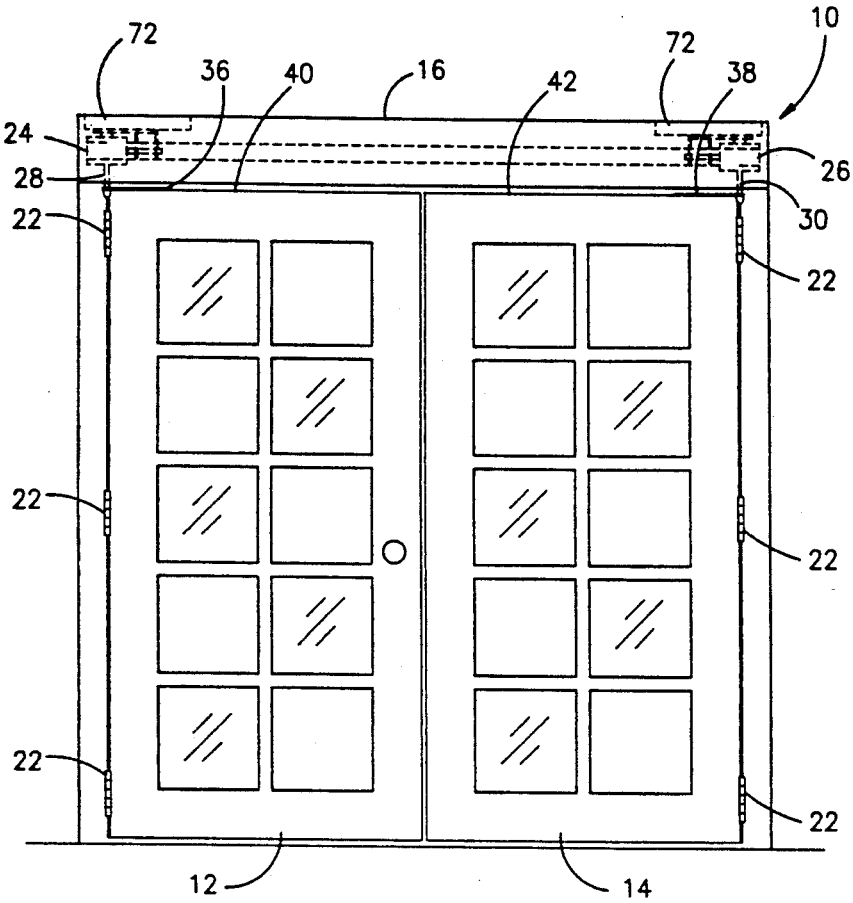
FIG. 1 is a front view showing the present invention as dotted lines mounted as individual components above a conventional double swinging door assembly.
Figure 2:
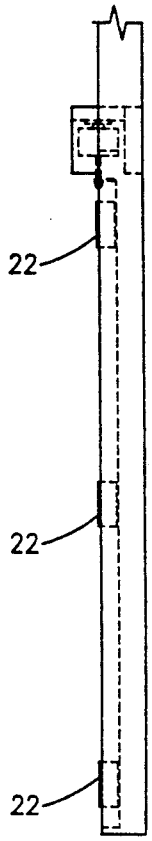
FIG. 2 is a side view of the apparatus mounted above the door assembly and showing the hinge mountings of the doors.
Figure 4:
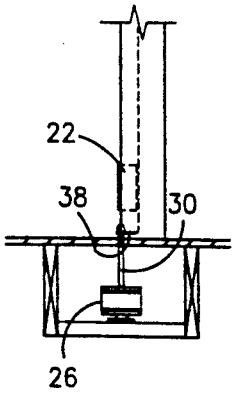
FIG. 4 is a side view of the apparatus installed below a door assembly.

FIG. 1 shows the mounting relationship of the present invention to the double swing doors 12 and 14. In the illustrated embodiment, the double door swing control apparatus 10 is mounted within the conventional framing 16 above the doors 12 and 14. The apparatus is designed to be used with modern conventional door mountings wherein the pivot axis of rotation, controlled by the location of the mounting hinges 22 in relation to the doors 12 and 14, is external to the doors. In the illustrated embodiment, the brackets or attachment means 36 and 38 are attached to the top surface 40 and 42 of the double swing doors 12 and 14. The brackets 36 and 38 are connected to spools 24 and 26 by shafts 28 and 30. Thus it is seen that movement of either door causes its associated bracket to move, resulting in the rotation of the connected shaft and spool. As shown in FIGS. 2 and 4, the pivot axes of the shafts 28 and 30 substantially coincide with the axes of rotation of the doors 12 and 14 on their hinges 22.

Figure 3:
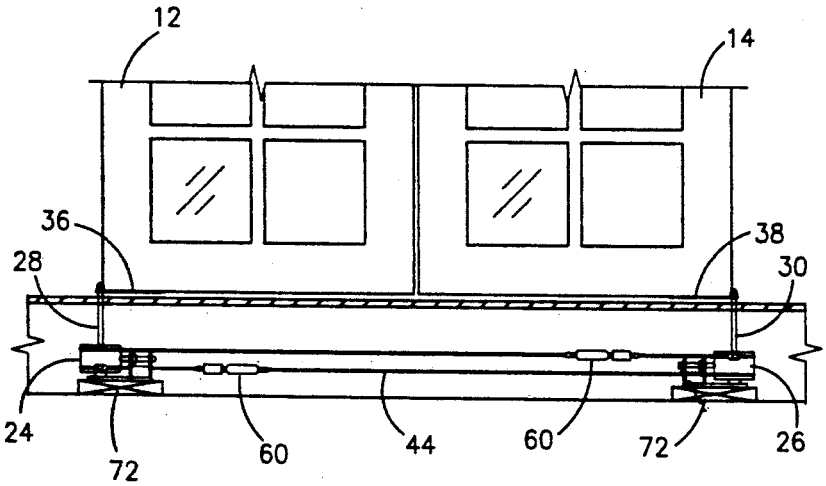
FIG. 3 is a front view showing the invention installed below the door assembly.

The double door swing control apparatus 10 is mounted in the conventional framing 16 by means of a door control frame. The door control frame may be a pair of mounting plates 72 (FIGS. 1 and 3). The spools 24 and 26 are rotatably mounted on mounting plates 72 which are adapted to be secured to the conventional frame 16. Each spool preferably houses a concentric bushing in the underside thereof which receives the upright post on which the respective spool is rotatably mounted. Alternatively, the invention contemplates the control apparatus designed as part of a kit wherein the door control frame may be a single mounting member 74 such as a "C" channel or the like, upon which the spools 24 and 26 and associated hardware are mounted, thereby forming an installation kit. The "C" channel member (FIGS. 5 and 6) may then be secured to the conventional frame 16.

An alternative location for installation of the apparatus is shown in FIGS. 3 and 4. As shown in the figures, the apparatus may be mounted within the floor structure below the door. As with the overhead mounting, brackets 36 and 38 are connected to the rotating spools 24 and 26 by means of shafts 28 and 30 or other similar connections means. The pivot axes remain that of the hinges 22.

Figure 5:
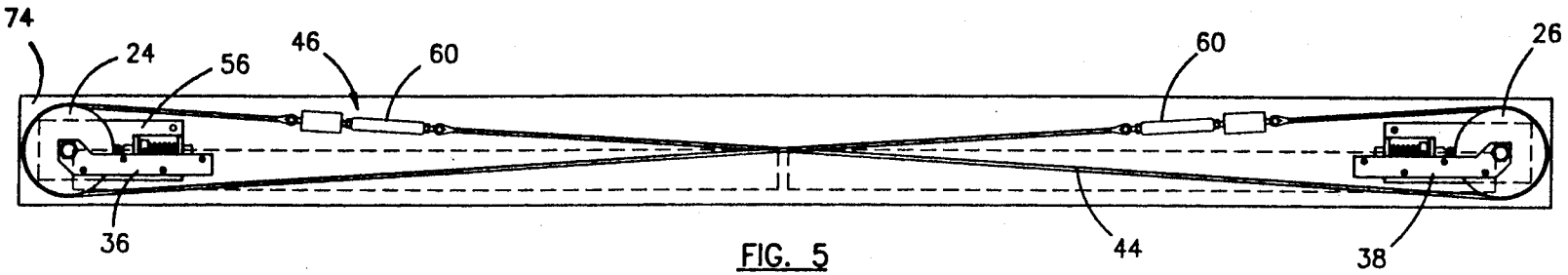
FIG. 5 is a top view showing the apparatus, including the cables and associated shock absorbers.
Figure 6:
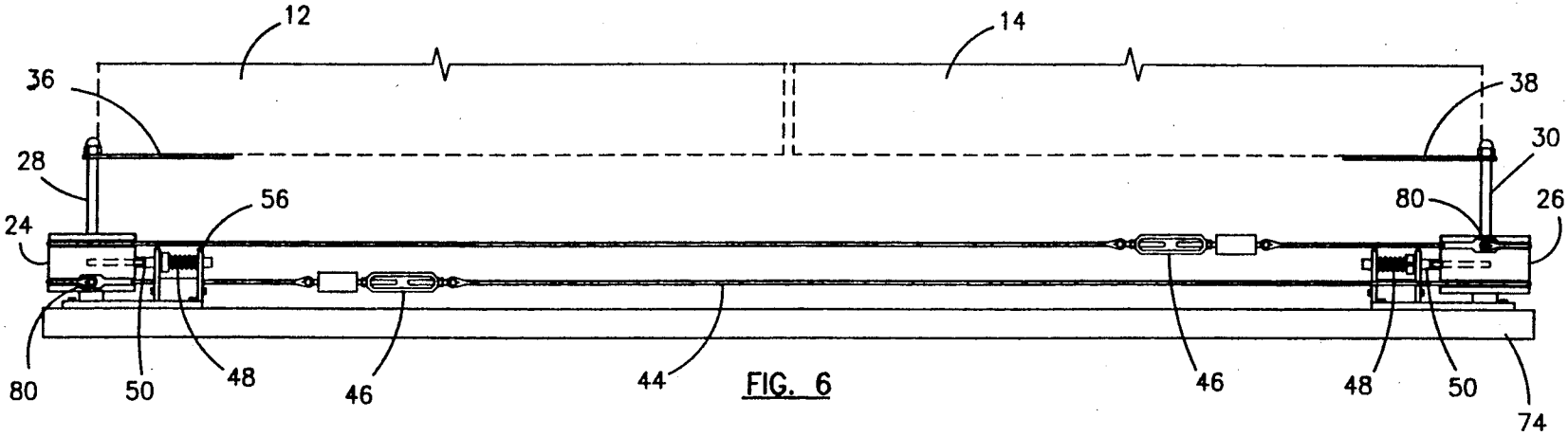
FIG. 6 is a front view of the apparatus as part of an installation kit showing the horizontal and vertical placement of various components of the apparatus.

FIGS. 5 and 6 show details of the control apparatus from the top and front perspectives respectively. In these figures, the control apparatus is shown as an installation kit wherein the spools 24 and 26 are mounted on a single mounting member 74 such as a "C" channel or the like and wherein the kit may then be installed as an integral unit into the door frame 16 or in the flooring below the door. Also shown in the figures, shock absorbers 46 are interconnected with each tension cable 44. In addition to securing the ends of each cable 44, the shock absorbers 46 serve two additional functions. First, they provide a means for adjusting the tension in each cable 44. Second, they provide a means for absorbing and dampening any acceleration (shock) produced by a sudden movement of the doors 12 and 14.

Figure 13:
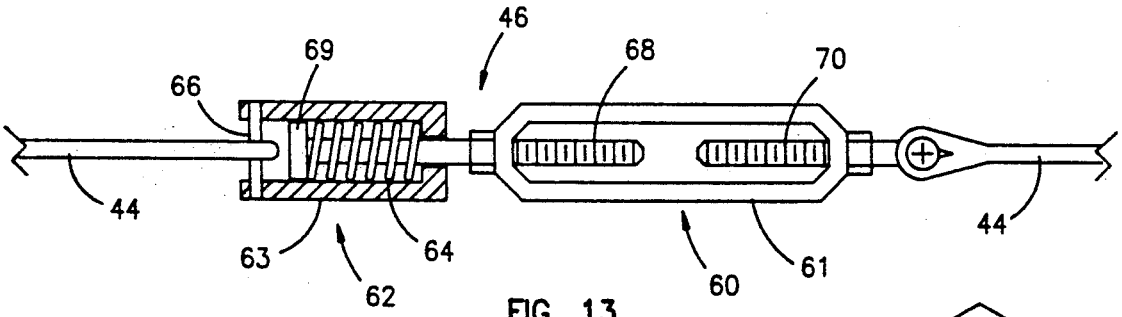
FIG. 13 is a detailed view of a shock absorbing member interconnected with a tension cable.

Details of the shock absorber 46 are shown in FIG. 13. Each shock absorber 46 comprises a tension adjustment means 60 and a connection means 62. A tension adjustment means 60 is provided to adjust the tension in cable 44. The tension adjustment means may be a turnbuckle wherein the tension is adjusted by a rotation of the body 61 causing the screw 70 and bolt 68 to move into or out of the body 61. Additionally, a connection means 62 is provided to connect the cable 44 and the tension adjustment means 60. The connection means 62 may include a generally cup shaped body 63 having a pin 66 across the open end thereof for attachment to the cable 44, an absorbing spring 64, and a bolt 68. The turnbuckle bolt 68 extends through an opening in the closed end of body 63 and has a head 69 adapted to compress a spring 64 between it and the body to further absorb impact loads and prevent damage to the control apparatus 10. Any sudden movement of the doors is translated to the cable 44 causing a momentary increase or decrease in cable tension. Such momentary increase or decrease of tension is effectively absorbed by a contraction of the spring 64.

Figure 7:
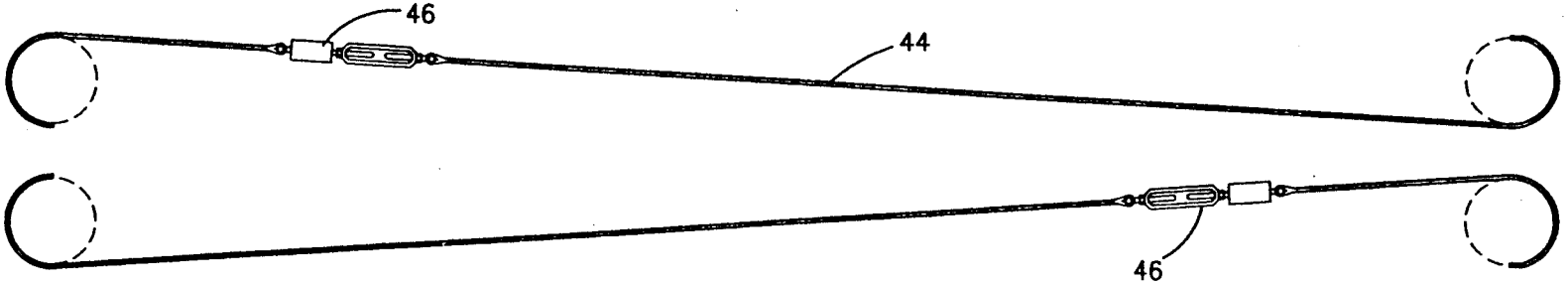
FIG. 7 is a top view showing the cross-over design of the cables, used to engage the two spools, and the cables associated shock absorbers.

Each tension cable 44 is securely fastened to the spools 24 and 26 by securement means 80 (FIGS. 6 and 8) such that rotation of one spool 24 or 26, results in the equal rotation of the other spool 26 or 24. The cable securement means 80 may be a screw or the like. Due to the "cross-over" design of the tension cables 44 as shown in FIGS. 5 and 7, the rotation of the two spools is in opposite directions. Opposite rotation of the spools 24 and 26 is required since the doors 12 and 14 pivot in opposite directions when opening. For example, if opening the right door is characterized by a pivoting in the clockwise direction, opening of the left door will be characterized by a pivoting in the counterclockwise direction. This unison of spool rotation, in opposite directions, is what allows both doors 12 and 14 to be opened simultaneously.

Seen clearly in FIGS. 5 and 6 are the interconnecting relationships between the spools 24 and 26, the shafts 28 and 30, and the brackets 36 and 38. The brackets 36 and 38 are attached to either the top or bottom surface of the doors 12 and 14. Additionally, the brackets 36 and 38 are attached to shafts 28 or 30. Such connection may be by a nut and bolt arrangement as shown in FIG. 14 or by any number of alternatives.

Figure 14:
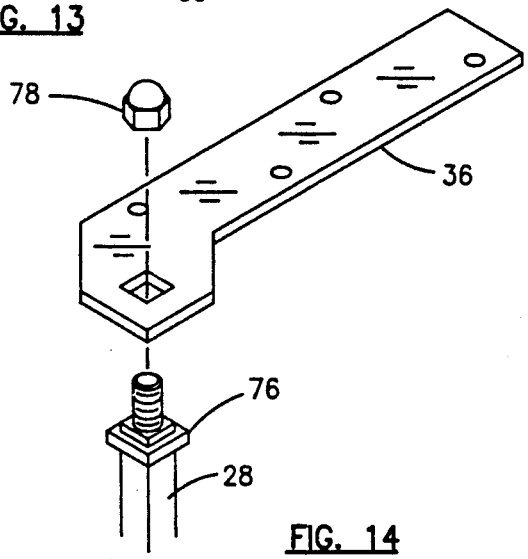
FIG. 14 is an exploded view showing the interconnection of the shaft, bracket, and nut.

Details of the interconnection between the brackets 36 and 38 and the shafts 28 and 30 are shown in FIG. 14. The shaft 28 is generally square shaped and sized such that it allows bracket 36 to receive and frictionally engage shaft 28 through the opening at the end of the bracket 36. Bracket 36 is then seated on flange 76 and securely fastened to shaft 28 by means of nut 78 or the like.

Thus a sturdy, substantially rigid interconnection between the doors 12 and 14 and the spools 24 and 26 is established. It is seen that such an interconnection results in the rotation of spools 24 and 26 when door 12 or 14 is opened. Additionally, with the tension cable 44 installed as shown and as described above, rotation of one spool 24 or 26 causes an equal and opposite rotation of the other spool 26 or 24. Therefore, an opening of one door 12 or 14 will cause an opening Of the other door 14 or 12.

Figure 8:
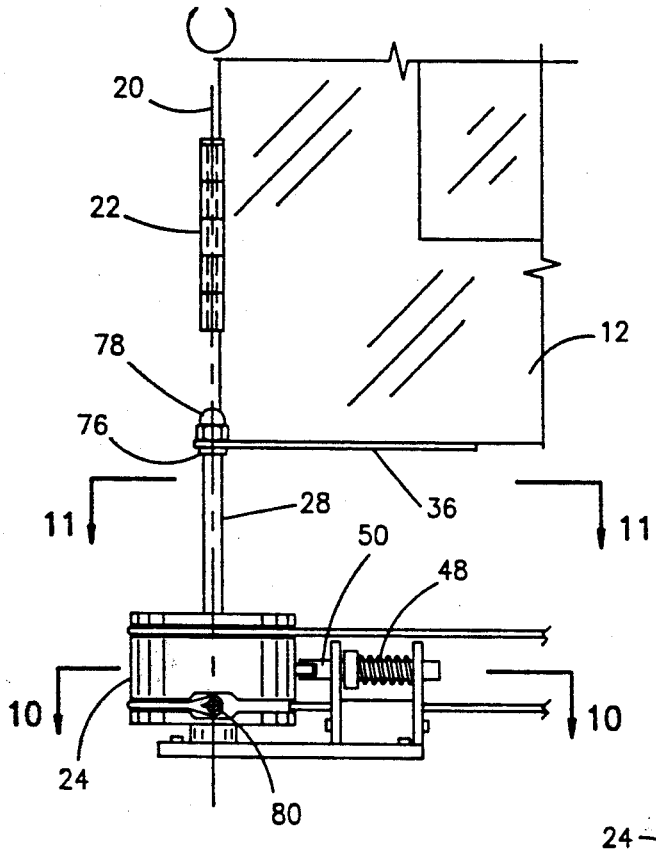
FIG. 8 is a front view showing the interconnection of the door, the bracket, the shaft and the spool and their associated axes of rotation.

The axis of rotation 20 of the door 12 or 14 on its associated hinge 22 is substantially the same as the axis of rotation of the shaft 28 or 30 as seen in FIG. 8. This feature allows the present invention to be installed on doors incorporating the modern off-door pivot axis design.

Due to the offset position of the pivot axes of the doors just forwardly of the front surface of each door as seen best in FIG. 5, the outer end surfaces of the doors would butt against one another upon opening of the doors unless sufficient clearance is provided between them. To minimize the gap between the doors in their closed positions for aesthetic purposes, it is preferred that those end surfaces be beveled to present nonparallel surfaces in the closed position of the doors. Thus the gap between the front surfaces of the doors may be minimal.

Figure 10:
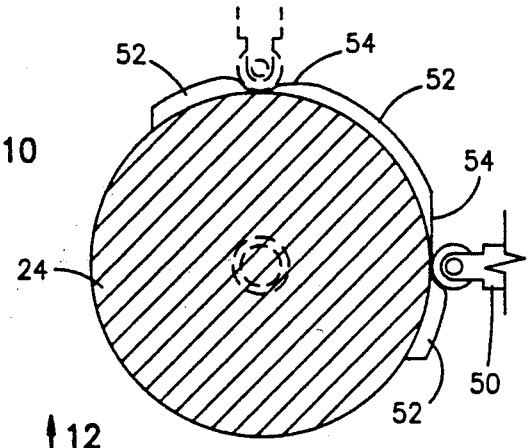
FIG. 10 is a top view of the spool showing the biasing track, its attachment to the spool, and the biasing positions.
Figure 9:
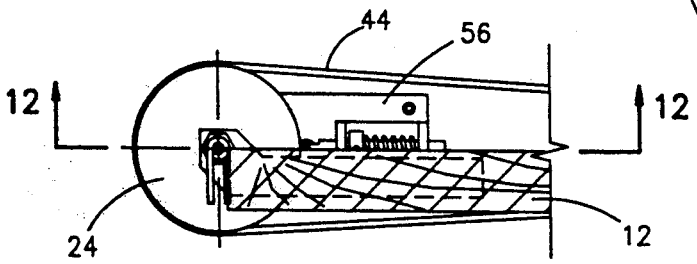
FIG. 9 is a top view of the connection between the door, the bracket and the spool.
Figure 11:
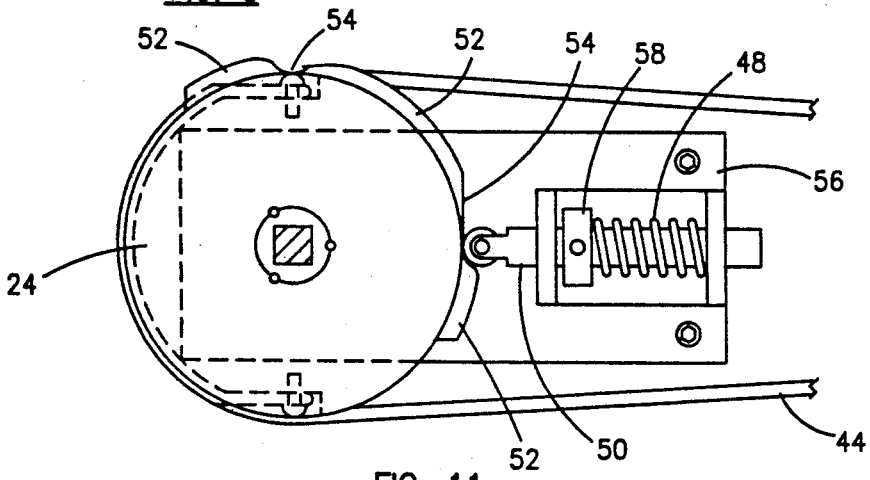
FIG. 11 is a top view showing the spool, biasing track, biasing pin and spring.
Figure 12:
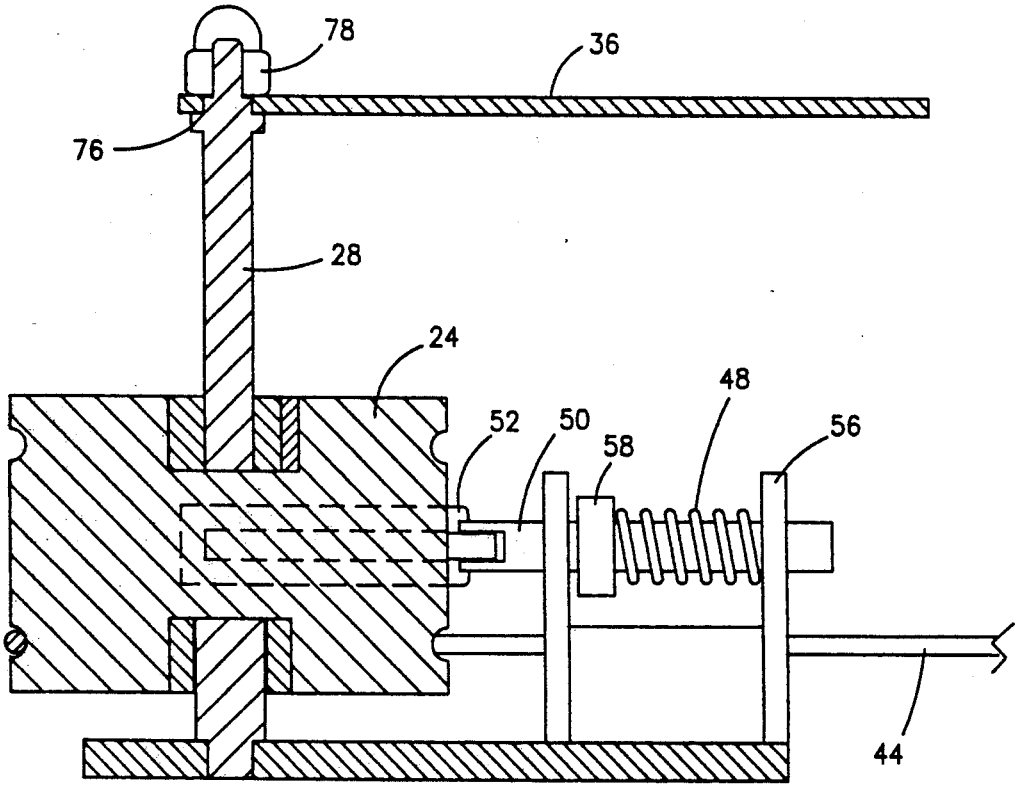
FIG. 12 is a cross-sectional view of the rotating spool and its interaction with the biasing pin and spring.

The installation and operation of the biasing feature of the present invention is best shown in FIGS. 10 and 11. A biasing track 52 having a plurality of recesses 54, is attached to the exterior surface of each spool 24 and 26. Such attachment may be by screws or other means. Biasing pin 50 is urged against biasing track 52 due to pressure exerted by biasing spring 48 between the biasing frame 56 and biasing pin collar 58. Biasing pin 50 is free to move along all of biasing track 52 allowing rotation of spools 24 and 26 to all positions. However, recesses 54 in track 52 tend to bias the spools 24 and 26 into positions corresponding to the recesses 54. The track 52 and recesses 54 may be constructed and attached to spools 24 and 26 in such a way that recesses 54 correspond to the full open and full closed positions of the doors 12 and 14. Thus, When the doors 12 and 14 are opened, they may be maintained in that position, resisting closure due to small wind gusts or the like. However, pressure exerted by the hand will easily cause the door to close in the normal fashion.

It can be seen from FIGS. 10 and 11 that biasing track 52 has a greater thickness at its ends and a lesser thickness inbetween. This allows for a greater ease of movement in the zone corresponding to movement of the door between the fully opened and fully closed positions, and a resistance to movement of the door beyond the fully open and fully closed positions. It will also be noted that the slope of the track 52 into the recesses 54 is smaller on the side corresponding to the normal movement zone. This coaxes the door into the fully opened or fully closed position when being moved, such that the door is substantially self opening/closing when nearing the recess. This is also a helpful feature because the beveled outer end surfaces of the doors do not accommodate conventional hardware having a latch extending perpendicularly outwardly from one door end for receipt within a socket in the other door. The detent track system of the invention eliminates the need for latching hardware since it releasably secures the doors in their closed positions. Locking hardware may be provided adjacent the top and bottom edges of one or both doors to lock the doors relative to the top door frame or floor for security in the case of doors on external walls of a structure.

Likewise, substitute tracks 52 of different lengths may be provided to accommodate various angles for the "door open" position. Whereas a position displaced 90° from the closed position is most common for the open position, other environments may provide thicker walls which are beveled or angled adjacent the door opening to accommodate a 135° swing, for example, of each door to its open position. The recesses 54 would be appropriately spaced further apart than in the illustrated embodiment to provide for the greater swing to the open position.

While the invention has been described in a preferred embodiment, it will be seen that many modifications, additions, and alternatives are possible which are within the intended broad scope of the appended claims.

Thus there has been shown and described a double door swing control apparatus which accomplish at least all of the stated objectives.

I claim:

1. A double door swing control apparatus for facilitating the simultaneous opening of a pair of conventional separately hinged double swing doors having top, bottom, inner, and outer surfaces and having hinges attached externally to said outer surfaces such that the pivot axis of the door is external to the door itself comprising:

door control frame means adapted to be mounted in vertically spaced relation to said doors;

a pair of rotating members mounted on said door control frame means;

a pair of attachment means, each of said attachment means adapted for securement to one of said door surfaces;

a pair of shafts, each shaft connected between a rotating member and a respective one of said attachment means for rotation of said rotating member, shaft and attachment means in unison about the pivot axis of a respective door;

a tension member connected to and extending between said rotating members such that rotation of one rotating member causes an equal and opposite rotation of the other rotating member whereby a pair of double swing doors having said attachment means secured thereto are opened and closed in unison;

said attachment means further comprising a member extending generally outwardly of said door surface and to said pivot axis;

said rotating member comprising a spool;

said attachment means comprising a bracket operative to engage said shaft, such that pivoting of said door causes movement of said attachment means, causing rotation of said shaft, and rotation of said spool;

said tension member comprising a pair of cables and a plurality of shock absorbing members, said shock absorbing members being interconnected to said cables, said shock absorbing members being operative to absorb shock resulting from sudden opening of said door and operative to adjust the tension in said cables, and wherein said cables are secured to said spools; and a raised member attached to each of said spools and having a plurality of recesses therein, a biasing member movably mounted on said frame means, a spring, said spring urging said biasing member against said raised member such that said spool is biased into positions corresponding to the positions of said recesses on said raised member and wherein said raised member has increased thickness at the ends thereof resulting in resistance to rotation of said spools in areas corresponding to said increased thickness the raised member between the recesses thereof being an area of decreased thickness.

2. The invention of claim 1 wherein said recesses in said raised member further includes sloping edges wherein the slope of said edge is smaller on said edge adjoining said area of decreased thickness in said raised member, thus coaxing said door into said recesses when being moved, such that said door is substantially self-opening/closing when near said recess.

3. The double door swing control apparatus of claim 2, wherein said door control frame is mounted in a frame structure located above said double swing doors.

4. The double door swing control apparatus of claim 3, wherein said door control frame is mounted in a frame structure located below said double swing doors.

5. In combination, a double swing door including a pair of separately hinged doors, each having top, bottom, inner, and outer surfaces and having hinges attached externally to said outer surfaces such that the pivot axis of the respective door is external to the door itself;

a door control frame means adapted to be mounted in a vertically spaced relation to said doors;

a pair of rotating members mounted on said door control frame means;

a pair of attachment means, each of said attachment means adapted for securement to one of said door surfaces;

a pair of shafts, each shaft connected between a rotating member and a respective one of said attachment means for rotation of said rotating member, shaft and attachment means in unison about the pivot axis of a respective door;

a tension member connected to and extending between said rotating members such that rotation of one rotating member causes an equal and opposite rotation of the other rotating member whereby said pair of doors having said attachment means secured thereto are opened and closed in unison;

said attachment means further comprising a member extending generally outwardly of said door surface and to said pivot axis;

said rotating member comprising a spool;

said attachment means comprising a bracket operative to engage said shaft, such that pivoting of said door causes movement of said attachment means, causing rotation of said shaft, and rotation of said spool;

said tension member comprising a pair of cables and a plurality of shock absorbing members, said shock absorbing members being interconnected with said cables, said shock absorbing members being operative to absorb shock resulting from sudden opening of said doors and operative to adjust the tension in said cables and wherein said cables are secured to said spools; and a raised member attached to each of said spools and having a plurality of recesses therein, a biasing member movably mounted on said frame, a spring, said spring urging said biasing member against said raised member such that said spool is biased into positions corresponding to the position of said recesses on said raised member and wherein said raised member has increased thickness at the ends thereof resulting in resistance to rotation of said spools in areas corresponding to said increased thickness the raised member between the recesses thereof being an area of decreased thickness.

6. The combination of claim 5 wherein said recesses in said raised member further includes sloping edges wherein the slope of said edge is smaller on said edge adjoining said area of decreased thickness in said raised member, thus coaxing said door into said recesses when being moved, such that said door is substantially self-opening/closing when near said recess.

7. The combination of claim 6, wherein said door control frame is mounted in a frame structure located above said double swing doors.

8. The combination of claim 7, wherein said door control frame is mounted in a frame structure located below said double swing doors.

9. The combination of claim 5 wherein the outer surfaces of said door are beveled to present nonparallel surfaces upon movement of the doors to the parallel closed positions thereof thereby to avoid interference upon opening movement of said doors.

* * * * *